United States Patent [19]

Cheshire

[11] Patent Number: 4,789,922

[45] Date of Patent: Dec. 6, 1988

[54] EARTHQUAKE SAFETY LIGHT

[75] Inventor: Thomas Cheshire, Rte. 2, Box 86A, Bishop, Calif. 93514

[73] Assignees: Thomas Cheshire; Douglas A. Stanek, both of Bishop, Calif.

[21] Appl. No.: 54,485

[22] Filed: May 27, 1987

[51] Int. Cl.[4] ..... H01H 35/02

[52] U.S. Cl. ..... 362/158; 362/802; 200/61.52; 200/61.45 R

[58] Field of Search ..... 362/802, 158, 190; 200/61.45 R, 61.5, 61.83, 85 R, 61.52; 340/669

[56] References Cited

U.S. PATENT DOCUMENTS

| | | | |
|---|---|---|---|
| 1,178,719 | 4/1916 | Hildebrand | 200/61.52 |
| 3,542,984 | 11/1970 | Kirk et al. | 200/61.45 R |
| 3,733,448 | 5/1973 | Brady | 200/61.45 R |
| 3,878,858 | 4/1975 | Yamada | 200/61.45 R X |

FOREIGN PATENT DOCUMENTS

| | | | |
|---|---|---|---|
| 1223648 | 6/1960 | France | 200/61.45 R |
| 316885 | 4/1934 | Italy | 200/61.52 |
| 287780 | 3/1928 | United Kingdom | 200/61.52 |
| 779272 | 7/1957 | United Kingdom | 200/61.45 R |

*Primary Examiner*—Tony M. Argenbright
*Assistant Examiner*—Eric R. Carlberg
*Attorney, Agent, or Firm*—Herbert C. Schulze

[57] ABSTRACT

A light suitable to be mounted upon the wall of a building or a room thereof wherein the light contains an apparatus comprising a weighted object which will be displaced at the existence of an earthquake of a given, preset magnitude and upon being displaced will close a circuit activating an emergency light in such manner that occupants in the area may see the light and be guided by it. The light is battery activated and may be of the type which is continually charged by normal household current and may include a low drain test light to indicate battery condition.

6 Claims, 2 Drawing Sheets

EARTHQUAKE SAFETY LIGHT

CROSS REFERENCE TO RELATED PATENT APPLICATIONS

There are no patent applications filed by me related to this application.

BACKGROUND OF THE INVENTION

I. Field of the Invention

This invention is in the general field of emergency lights; this invention is even more particularly directed to emergency lights mounted upon a building or within a room or other enclosure; it is even more particularly directed to a light which will be activated by the occurrence of an earthquake by means of displacement of an element which closes an electrical circuit.

II. Description of the Prior Art

There is no prior art known to me in this field. There are many wall mounted lights which are used for, and activated by, the general loss of power in an area. Such lights are effective for their intended use, but are of no value in an earthquake, where the primary power is not totally interrupted, as is the situation in many earthquake conditions.

SUMMARY OF THE INVENTION

People throughout the World are becoming more aware of earthquakes and earthquakes seem to be occurring with great frequency.

Frequently earthquakes occur at night, with or without power interruption. When earthquakes occur at night it is sometimes impossible for the occupant of a bui;lding to find his or her way about safely. Flashlights are not always readily available and may even be displaced by the earthquake.

Many injuries have resulted from persons being unable to find their way about in the dark after a severe or moderately severe earthquake, which injuries could have been avoided had the individual been able to see a particular familiar portion of the building or been able to see a visable light which was available to guide him.

I have studied this at considerable length, and have particularly studied and examined the affect upon a building of earthquakes of various magnitudes. In many instances, a building wall, or the like, may not become severely displaced in any particular direction, but may only feel the effect of the earthquake jolt.

I have studied and experimented with various types of electrical switching devices and the like in order to ascertain a switching device which might be activated by an earthquake even though the wall or other structure to which it may be affixed may not be disturbed in either vertical or horizontal alignment. I have found that such switches do not exist.

I have experimented with this problem and have fairly conceived and prefected an effective earthquake light, in which the light will be activated by a jolt, even though there is no horizontal or vertical movement sufficient to activate existing switching devices.

I have accomplished my goal by the use of a weighted element which is displaced from a position by means of a jolt and then moves to a position where it activates an electrical current, in turn activating a light, even though there has been no movement of the case and the mounting for such object. In a preferred form, I utilize a steel ball mounted upon a pedestal wherein a jolt will make it fall from the pedestal and close an electrical circuit, activating a light.

I have provided a unit which may be mounted to a wall by screws or the like or may be mounted on the floor or may be mounted on piece of furniture such as a table or the like.

It is an object of this invention to provide a wall mounted light which is automatically activated upon the occurrence of an earthquake of a predetermined magnitude;

Another object of this invention is to provide such a light as has heretofore been described such that there is a constant automatic indication of battery condition for the light;

Another object of this invention is to provide such a device as has been described wherein the battery within the unit may be constantly recharged pending its use.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 5 is an exploded view showing most of the elements of the apparatus but eliminating wiring and the like.

DESCRIPTION OF A PREFERRED EMBODIMENT

Figure 1:
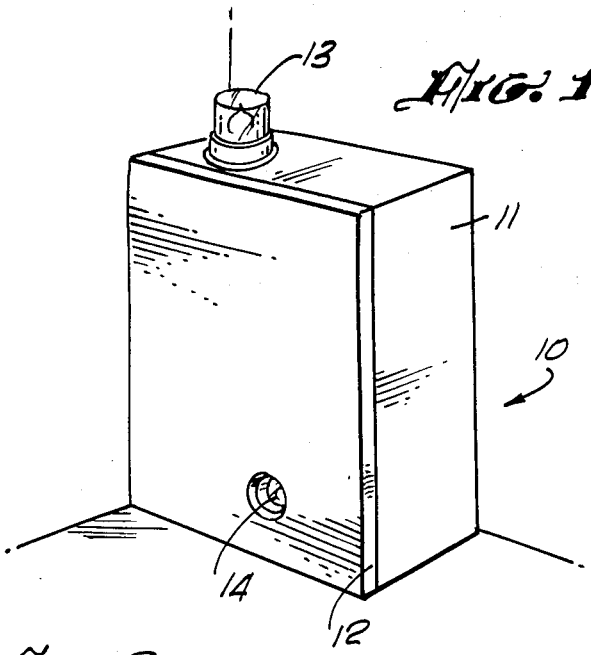
FIG. 1 is a perspective of a preferred form of an apparatus embodying the principles of this invention.
Figure 4:
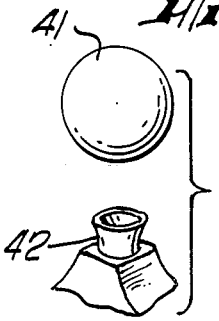
FIG. 4 is an enlarged broken away perspective of the activator device.

In a preferred form, the earthquake light of this invention shown in FIG. 1 as generally 10 will be located in a corner of a room or fastened to a wall or mounted upon a piece of furniture or the like or otherwise mounted by means known to those skilled in the arts. The earthquake light 10 comprises a cabinet 11 with a removable front over 12, a light element 13, and an opening 14 enclosing a light emitting diode, or the like, which will flash intermittently to indicate that the batteries which operate this device are in good operating condition.

Figure 2:
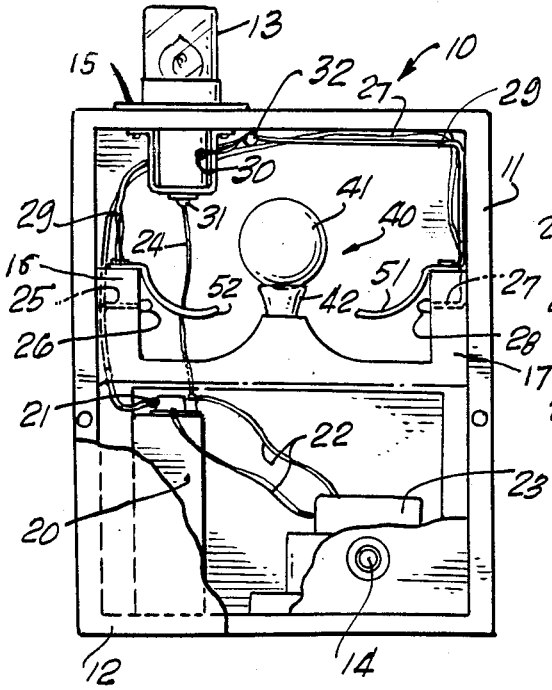
FIG. 2 is an enlarged front view, partially broken away of the apparatus of FIG. 1 illustrating the internal components.

In FIG. 2, the front cover 12 has been broken away so as to show the elements within the case 11. The light element 13 will be a strong light such as a powerful flashlight lamp mounted appropriately in a socket 30 having two terminals 31 and 32 for electrical connection. Terminal 31 will have a direct connection by wire 24 to one terminal of battery 20. Socket 30 will be connected by wires 29 joined together at terminal 32 (which is shown at a distance from the actual socket for clarity, it being understood that it will be in contact with the light element within the socket) two spring elements on the wooden ledge on each side 16 and 17 as shown. There is an electrical conducting button or the like 26 and 28 on each of the ledges and immediately below the spring elements 51 and 52. Wire 27 connects directly from connecting elements 28 to the battery, and is also connected by wire 25 as indicated to conducting element 26.

Figure 3:
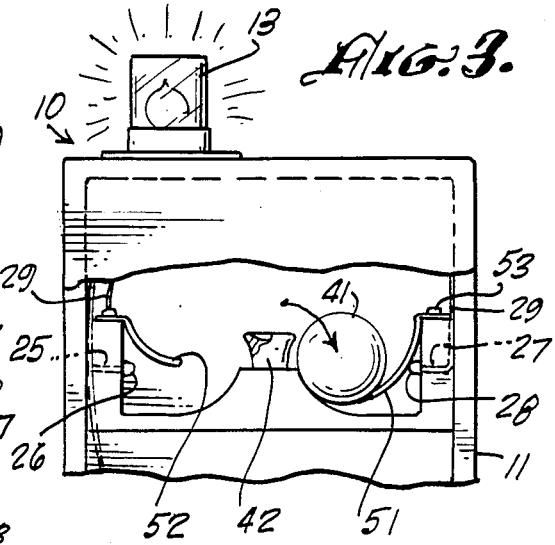
FIG. 3 is a partially broken away view of the upper portion of FIG. 2 wherein the device has been activated.
Figure 5:
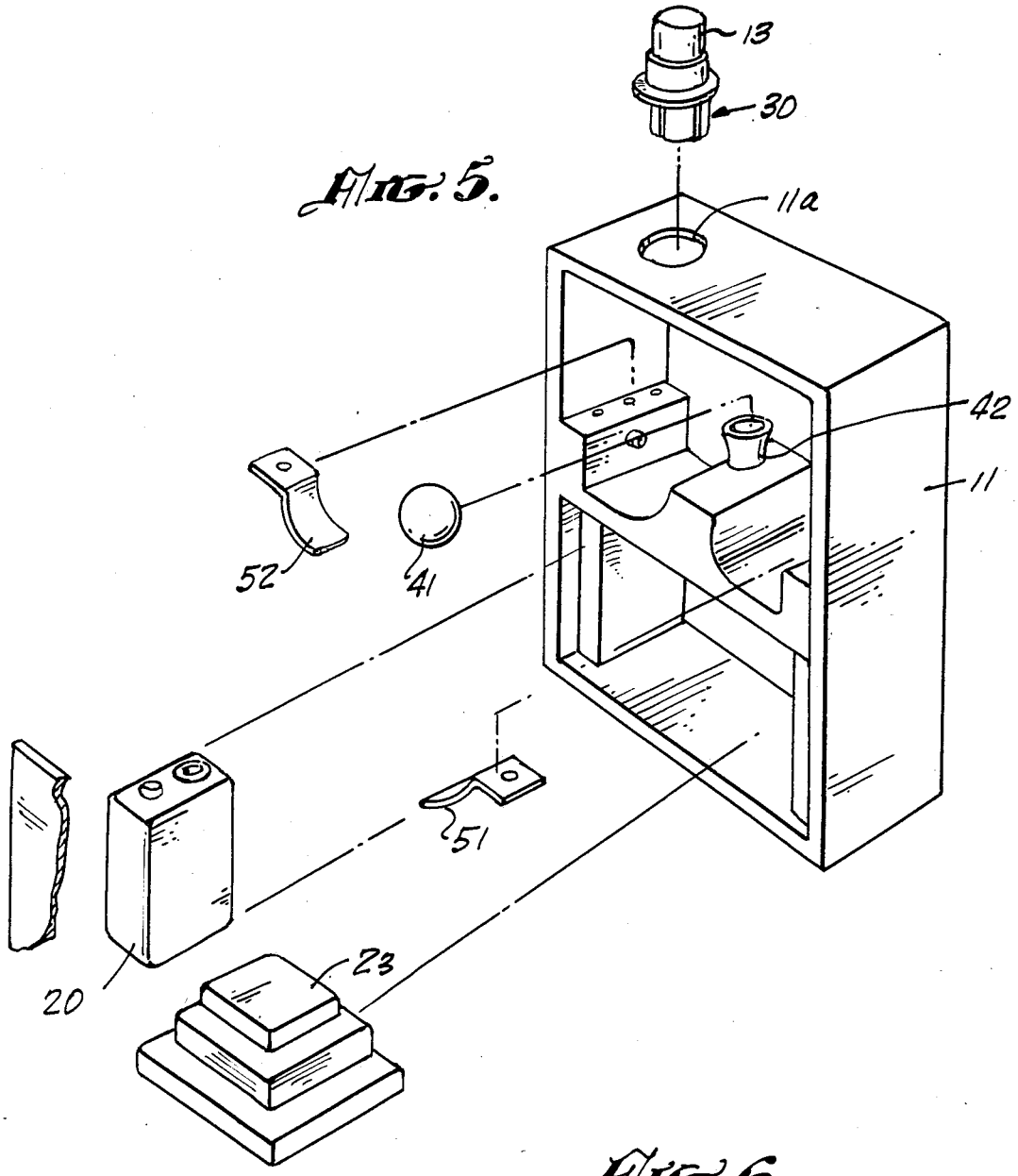
Figure 6:
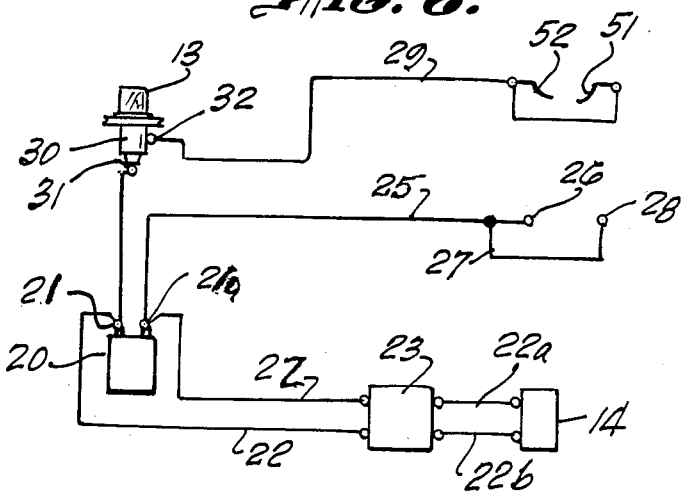
FIG. 6 is a schematic diagram of the wiring system.

In activation, the ball 41 is resting on pedestal 42 and when an earthquake is felt, the ball will fall to the right or left and will depress one of the springs 52 or 51 so that it touches the contact 28 or 26 thus making a circuit through the wire 27 to the terminal 30 thus activating the light, as is shown in FIG. 3.

In addition to the wires 24 and 27 which are connected to the terminals of the battery, two wires 22 are connected to the two terminals and run to a transformer 23 through which is activated a very low drain light emitting diode 14, which operates intermittently by means known to those skilled in the art. This is to show that the battery is in good condition. In the event the light emitting diode 14 should cease its blinking, then the person using this device would know it was time to change the battery. I prefer to use a nine volt battery of customary construction, although any suitable battery may be used for battery 20. It is possible to obtain batteries which are intregal with a charger or which may be connected to a trickle charger. This has not been shown, but such batteries could be used.

The springs 51 and 52 are held in position by screws or the like and in turn the same device which holds them in position upon the ledges 16 and 17 can be utilized to connect to the wire 29.

By experimentation, the size of the ball 41 and the pedestal 42 can be adjusted so that this device will only activate upon the occurrence of an earthquake of a given magnitude.

The schematic view illustrates the elements of this invention and how the circuit is closed from wire 25 through wires 27 at the contact buttons 26 and 28 through contact to either of the spring elements 51 and 52 and thus into the socket connection 32. It also illustrates the wiring to the transformer 23 and light emitting diode blinker unit 14.

While the embodiment of this invention shown and described is fully capable of achieving the objects and advantages desired, it is to be understood that this embodying is shown for purposes of illustration only and not for purposes of limitation.

I claim:

1. Apparatus for lighting an emergency light for guidance purposes upon the occurrence of an earthquake comprising in combination: a generally rectangular casing comprising a top, bottom, two sides, back, and removable front; a bridge running transversly across the width of said case and fastened therein approximately midway between the top and the bottom of said case; a battery operated light located in and extending above the top of said case; a battery located beneath said bridge in the lower portion of said case; an electrical conducting element connected to a first terminal of said battery and to a first terminal of said light; a second connecting element connected to a second terminal of said light and connected to two conductive elements, each isolated from said battery at the end not connected to said second terminal of said light, so that no contact is existent between a second terminal of said battery and said two isolated conductive elements; a conductive element connected to a second terminal of said battery and terminating in a contact point adjacent, but not in contact with, each of the two isolated conductive elements; a movable electrical conducting element attached to each of said isolated contact points connected to said second terminal of said light, but not in contact therewith, each of said movable electrical conducting elements being connected to said bridge adjacent a pedestal located in its center portion; a weight located upon said pedestal suitable to be displaced from its place upon said pedestal by an earthquake of a given magnitude in such manner that will cause one of said flexible electrical contact means to contact said electrical contact means connected to the second terminal of said battery in such means as to force said electrical contact means into contact with said contact means connected to said second battery terminal means so as to complete the circuit and cause the light to be ignited.

2. The apparatus of claim 1 wherein the thickness of said case is such that the weight cannot drop off its pedestal without being held in a confined position such that it must be in contact with one of the flexible contact means.

3. The apparatus of claim 2 wherein said flexible contact means comprise semi-rigid, flat, curved conducting elements.

4. The apparatus of claim 3 wherein the said curve is approximately of the same curvature as the exterior curvature of a ball utilized upon said pedestal.

5. The apparatus of claim 4 wherein a small nine volt battery is utilized together with appropriate transitor elements so as to ignite said light with a minimum battery drain.

6. The apparatus of claim 5 wherein the said light comprises a light emitted diode.

* * * * *